United States Patent [19]

Chrupcala et al.

[11] Patent Number: 4,952,901

[45] Date of Patent: Aug. 28, 1990

[54] BIMETALLIC DISC ASSEMBLY FOR THERMOSTATIC SWITCH AND DISC RETAINER THEREFOR

[75] Inventors: John J. Chrupcala; Anthony F. Urban, both of Warren, R.I.

[73] Assignee: Elmwood Sensors, Inc., Pawtucket, R.I.

[21] Appl. No.: 455,979

[22] Filed: Dec. 22, 1989

[51] Int. Cl.[5] ..... H01H 37/04; H01H 37/52

[52] U.S. Cl. ..... 337/372; 337/354; 337/380

[58] Field of Search ..... 337/372, 380, 365, 354

[56] References Cited

U.S. PATENT DOCUMENTS

| | | | |
|---|---|---|---|
| 4,570,148 | 2/1986 | Ferroni et al. | 337/372 |
| 4,754,252 | 6/1988 | Craig, III | 337/372 |
| 4,791,397 | 12/1988 | Wells | 337/372 |
| 4,794,364 | 12/1988 | Uehara | 337/372 |

*Primary Examiner*—H. Broome
*Attorney, Agent, or Firm*—Salter & Michaelson

[57] ABSTRACT

A disc assembly for a bimetallic disc-actuated thermostatic switch is adapted to minimize response time. The switch includes a disc assembly comprising a disc retainer, and a bimetallic disc and a cap on the disc retainer. The disc retainer includes a central hub portion, a plurality of fingers which radiate outwardly from the hub portion, a plurality of disc retainer projections on the fingers adjacent the terminal ends thereof and a plurality of disc support shoulders on the fingers adjacent the disc retainer projections thereon. The fingers have open notches therebetween for reducing the cross sectional area of the material available in the disc retainer for conducting heat from the bimetallic disc to the body portion of a thermostatic switch on which the disc assembly is installed. The cap includes an end wall portion having an enlarged opening therein and a skirt portion having a plurality of apertures therein which reduce the cross sectional area of the material available in the skirt portion for conducting heat from the bimetallic disc to the body portion of a switch.

18 Claims, 2 Drawing Sheets

BIMETALLIC DISC ASSEMBLY FOR THERMOSTATIC SWITCH AND DISC RETAINER THEREFOR

BACKGROUND AND SUMMARY OF THE INVENTION

The instant invention relates to bimetallic disc-actuated thermostatic switches and more particularly to a bimetallic disc assembly and to a disc retainer therefor which are adapted to be assembled in a thermostatic switch for minimizing the response time of the switch.

It has generally been found that it is important for certain devices, such as coffee makers, copy machines and facsimile machines to include some means of protection against damage caused by thermal overload conditions. For this reason, devices of this type generally include thermostatic switches which are operative for interrupting the main heat generating circuitry components thereof in response to thermal overload conditions. However, it has been found that since thermal overload conditions can often develop very rapidly, it is essential for the thermostatic switches which are utilized in devices of this type to be operative with minimal response times in order to avoid damage resulting from thermal overload conditions.

The devices disclosed in the Craig, III U.S. Pat. No. 4,754,252 and Uehara U.S. Pat. No. 4,794,364 which represent the closest prior art to the subject invention of which the applicant is aware generally address the problem of minimizing the response times of bimetallic disc-actuated thermostatic switches to enable them to be more effectively utilized as thermal overload protection devices for various machines and appliances. However, while the devices disclosed in these references have generally been found to be operative with reduced response times, it has nevertheless been found that they are not operative with sufficiently rapid response times to make them satisfactory for all applications.

It has generally been found that in order to minimize the response time of a bimetallic disc-actuated thermostatic switch the bimetallic disc of the switch must be sufficiently exposed to the surrounding environment to enable the temperature of the disc to rapidly follow the temperature of the surrounding air. The aforementioned U.S. Patents to Craig, III and Uehara have generally addressed this requirement by providing enlarged openings in the end walls of the disc retainer caps thereof. However, it has now been found that in order to further minimize the response time of a bimetallic disc-actuated switch it is also important to minimize the amount of heat which is lost from the bimetallic disc of the switch through heat transfer to the elements which support and/or retain the bimetallic disc in position. It has been still further found that in order to minimize heat loss from the bimetallic disc of a switch it is not only important to minimize the areas of contact between the bimetallic disc and the disc supporting and/or retaining structure of the switch but it is also important to minimize the cross sectional areas of the thermally conductive paths between the disc supporting and/or retaining structure and the remaining portions of the switch.

The instant invention provides an improved disc assembly and disc retainer for a bimetallic disc-actuated thermostatic switch. In this regard, the disc retainer is adapted to minimize heat loss therethrough by minimizing the areas of contact between the disc retainer and a disc supported thereon and by also minimizing the cross sectional areas of the thermally conductive paths through the disc retainer to the remaining components of a bimetallic disc-actuated thermostatic switch in which the retainer is installed. In particular, the disc retainer of the instant invention comprises a central hub portion, a plurality of fingers which radiate outwardly from the central hub portion, a disc retainer projection adjacent the outer end of each of the fingers and a disc support shoulder adjacent each of the disc retainer projections. The disc retainer is adapted for receiving and supporting a bimetallic disc thereon so that the disc is supported on the shoulders on the fingers and retained in position by the disc retainer projections. However, because the retainer includes a plurality of fingers having open notches therebetween for supporting a bimetallic disc, the total cross sectional area of the thermally conductive paths through the retainer is limited to the sum of the cross sectional areas of those paths which pass through the fingers. As a result, the overall thermal conductivity through the retainer is reduced. The disc retainer includes at least three fingers and it preferably includes six fingers and the disc retainer is preferably integrally molded from a plastic material. Further, the disc retainer preferably has an axial aperture therethrough for receiving a transfer pin of a thermostatic switch so that the transfer pin is in engagement with the bimetallic disc for moving a moveable contact of the switch between open and closed positions.

The bimetallic disc assembly of the instant invention comprises a disc retainer of the above described type comprising a central hub portion and a plurality of fingers which radiate outwardly from the central hub portion, a bimetallic disc which received on the shoulders on the fingers and a cap element which is received on the disc retainer. The cap element preferably includes an end wall having an enlarged central opening therethrough so that the main portions of one side of the bimetallic disc are exposed to the surrounding atmosphere. The cap element preferably further includes a skirt portion having a plurality of apertures therethrough which are preferably substantially uniformly spaced around the circumference of the skirt portion. The skirt portion is adapted to be secured to the body portion of a thermostatic switch for retaining the disc assembly thereon. The arms of the disc retainer preferably have top and bottom faces and the apertures in the skirt portion of the cap are preferably oriented so that they are disposed partially above and partially below the bottom faces of the arms on the retainer so that the apertures function to reduce the total cross sectional area of the thermally conductive paths between the cap and the body portion of a switch on which the disc assembly is installed.

It has been found that the disc retainer and disc assembly of the instant invention can be effectively utilized for optimizing the response time of a bimetallic disc-actuated thermostatic switch. In particular, it has been found that the disc retainer and the disc assembly effectively minimize the total cross sectional area of the thermally conductive paths available for transferring heat to the body portion of a thermostatic switch and that as a result, they cooperate for enabling the bimetallic disc of the switch to retain a substantially greater portion of the heat transferred thereto from the surrounding environment. As a result, the bimetallic disc is capable of reaching its actuation point substantially more rapidly when it is exposed to a thermal overload condition so that the actuation time of a bimetallic disc-actuated thermostatic switch incorporating the retainer and disc assembly of the instant invention is substantially reduced.

Accordingly, it is a primary object of the instant invention to provide a disc retainer for a bimetallic disc-actuated thermostatic switch which is operative for minimizing the response time of the switch.

Another object of the instant invention is to provide an improved disc assembly for a bimetallic disc-actuated thermostatic switch which is operative for reducing the actuation time of the switch.

Another object of the instant invention is to provide a disc retainer for a bimetallic disc-actuated thermostatic switch which is operative for minimizing the cross sectional area of the thermally conductive paths between a bimetallic disc supported thereon and the body portion of a thermostatic switch on which the disc retainer is installed.

Another object of the instant invention is to provide a disc assembly for a bimetallic disc-actuated thermostatic switch comprising a cap which is adapted to reduce the total cross sectional area of the thermally conductive paths between the cap and the body portion of a thermostatic switch on which the cap is assembled.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention:

FIG. 2(*a*) is an exploded perspective view of a second embodiment of the disc assembly per se.

DESCRIPTION OF THE INVENTION

Figure 2A:
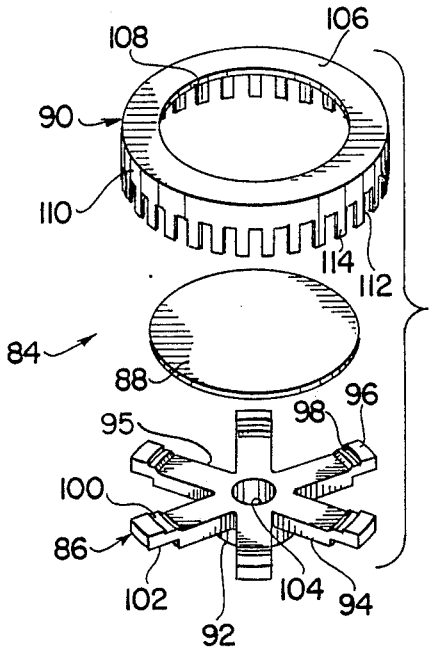
FIG. 2 is an exploded perspective view thereof.
Figure 1:
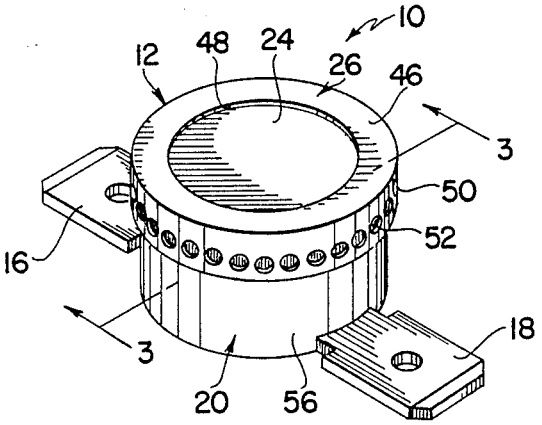
FIG. 1 is a perspective view of a bimetallic disc-actuated thermostatic switch which includes the disc assembly and disc retainer of the instant invention.
Figure 2:
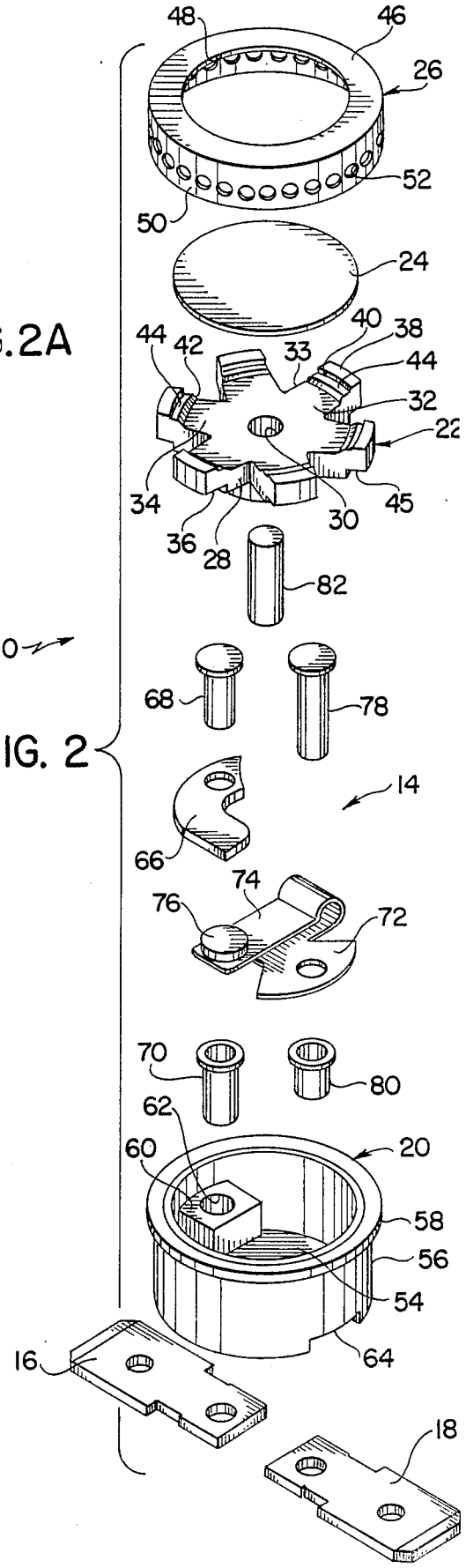
Figure 3:
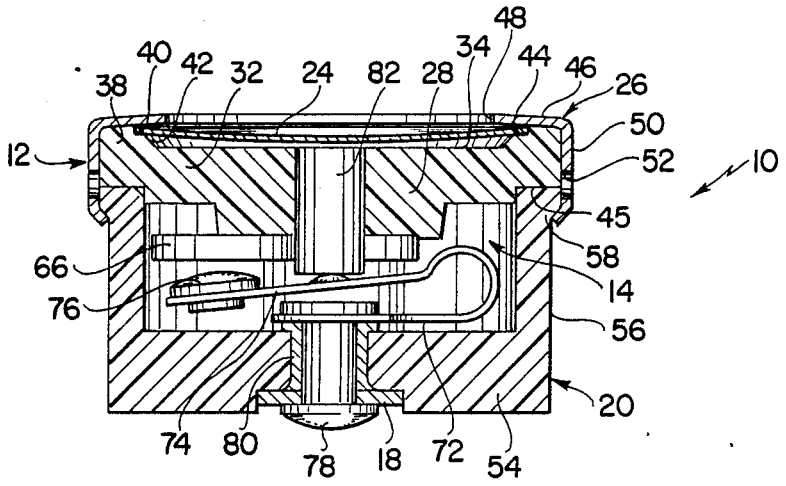
FIG. 3 is a sectional view taken along line 3—3 in FIG. 1.

Referring now to the drawings, a bimetallic disc-actuated thermostatic switch which includes the disc assembly of the instant invention is illustrated in FIGS. 1, 2 and 3 and generally indicated at 10. The thermostatic switch 10 includes a bimetallic disc assembly generally indicated at 12, a switching assembly generally indicated at 14, including first and second external electrical terminals 16 and 18, respectively, and a switch body generally indicated at 20. The disc assembly 12 includes a disc retainer generally indicated at 22, a bimetallic disc 24 and a cap generally indicated at 26. The disc assembly 12 and the switching assembly 14 are assembled with the body 20 so that the bimetallic disc 24 is operative for actuating the switching assembly 14 for selectively effecting and interrupting electrical continuity between the terminals 16 and 18 in response to a predetermined temperature condition. However, because of the manner in which the disc assembly 12 is constructed and assembled with the switching assembly 14 and the body 20, the disc assembly 12 is operative with a reduced response time for actuating the switching assembly 14 in response to a predetermined temperature condition.

The disc retainer 22 is preferably integrally molded from a suitable plastic material, such as a phenolic, and it includes a central hub portion 28 having an axial aperture 30 therethrough and at least three, but preferably six, fingers 32 which radiate outwardly from the hub portion 28 and define open notches 33 therebetween. The fingers 32 have opposite upper and lower sides 34 and 36, respectively, and upwardly projecting disc retainer projections 38 having inner faces 40 thereon are formed adjacent the terminal ends of the fingers 32. Also formed on the fingers 32 adjacent the inner faces 40 are disc support shoulders 42 having upper support surfaces 44 thereon. The disc support surfaces 44 are disposed substantially within a common plane, although they are elevated above the upper sides 34 of the fingers 32 by amounts which are less than the amounts by which the projections 38 are elevated above the upper sides 34. The outermost portions of the bottom or lower sides 36 of the fingers 32 are defined by undercut areas 45.

The bimetallic disc 24 preferably comprises a conventional bimetallic disc which is responsive to a predetermined temperature condition for exerting a flexing action as a result of the differences in the thermal expansion properties of the metals from which it is constructed. The disc 24 is dimensioned to be received on the disc retainer 22 so that it is supported on the support surfaces 44 of the shoulders 42 and contained within the projections 38.

The cap 26 is preferably made from a suitable sheet metal and it includes a substantially flat end wall portion 46 having an enlarged central opening 48 therein and a skirt or sidewall portion 50 which depends from the end wall portion 46. Formed in the sidewall portion 50 is a plurality of apertures 52 which are substantially uniformly circumferentially spaced around the sidewall portion 50. The cap 26 is dimensioned and configured to be received on the retainer 22 for retaining the disc 24 in position on the shoulders 44 so that the disc 24 can effectively communicate with the surrounding environment through the opening 48. The apertures 52 are oriented in the sidewall portion 50 so that they are disposed partially above and partially below the outermost portions of the bottom sides 36 of the fingers 32 so that the apertures 52 effectively reduce the cross sectional area of the metal in the sidewall 50 which is available for conducting heat from the disc 24 to the body portion 20 through the cap 26.

The body portion 20 is generally of conventional construction and it is preferably manufactured from a suitable high temperature insulating material, such as a phenolic or ceramic, as generally used on thermostatic controls. The body portion 20 includes a bottom wall portion 54, an upstanding sidewall portion 56, and an enlarged upper lip 58 on the upper extremity of the sidewall portion 56 and an inner shoulder 60 having an aperture 62 therethrough is formed in the interior of the body portion 20. Also formed in the body portion 20 is a recess 64 which is located on the outer side of the bottom wall 54.

The switching assembly 14 is received and assembled in the body portion 20 and it includes a fixed contact 66 which is secured on the shoulder 60 with a rivet 68 which passes through the fixed contact 66. The rivet 68 is received in an eyelet 70 which is in turn received in the aperture 62. The first terminal 16 is received in the recess 64 on the underside of the bottom wall 54 and the rivet 68 extends through the first terminal 16 for securing the first terminal 16 to the body portion 20 so that it is electrically connected to the fixed contact 66 through the rivet 68 and the eyelet 70. The switching assembly further comprises a moveable contact assembly 72 including a resilient contact arm 74 having a moveable contact element 76 thereon, a rivet 78 and an eyelet 80. The rivet 78 extends through the base portion of the moveable contact 72 and it is received in the eyelet 80 which is in turn received in an aperture (not shown) in the bottom wall 54 of the body portion 20. The second terminal 18 is assembled in the slot 64 on the underside of the bottom wall 54 so that it is spaced from the first terminal 16 and the rivet 78 passes through the second terminal 18 for securing it to the body portion 20. When the second terminal 18 and the moveable contact assembly 72 are secured to the body portion 20 in this manner the rivet 78 and the eyelet 80 both intimately engage both the moveable contact assembly 72 and the first terminal 18 to effectively electrically connect the moveable contact assembly 72 to the second terminal 18. When the moveable contact assembly 72 is assembled in the body portion 20 in this manner, the arm 74 is normally positioned so that the contact element 76 engages the fixed contact 66 to effect electrical continuity between the first and second terminals 16 and 18, respectively. However, the resilient arm 74 is resiliently deflectable downwardly to separate the moveable contact element 76 from the fixed contact 66 in order to interrupt electrical continuity between the first and second terminals 16 and 18, respectively. The switching assembly 14 further comprises a transfer pin 82 which is received in the interior of the body portion 20 so that it extends between the disc assembly 12 and the arm 74 for moving the moveable contact arm 74 downwardly in response to a predetermined temperature condition.

The disc assembly 12 is assembled on the body portion 20 so that the outermost portions of the finger 32 rest on the upper edge of the lip 58 and the lower edge portion of the skirt portion 50 of the cap 26 is crimped inwardly around the lower edge of the lip 58 to permanently secure the disc assembly 12 to the body portion 20. The disc assembly 12 is assembled with the body portion 20 so that the transfer pin 82 is received in the aperture 30 in the disc retainer 22 and accordingly, the transfer pin 82 extends between the bimetallic disc 24 and the resilient arm 74. Further, the transfer pin 82 is dimensioned so that when the disc 24 is in an upwardly flexed disposition, the arm 74 is in an "at rest" disposition wherein the moveable contact element 76 engages the fixed contact 66. However, when the disc 24 is moved to a downwardly flexed disposition in response to a predetermined temperature condition, the transfer pin 82 moves the arm 74 downwardly to move the moveable contact element 76 to a position of spaced disengagement from the fixed contact 66. Accordingly, electrical continuity between the first and second terminals 16 and 18, respectively, can be interrupted or effected in a conventional manner in response to predetermined temperature conditions.

It is obvious that the speed with which the thermostatic switch 10 responds to a temperature change in the surrounding environment depends on the speed with which the temperature of the bimetallic disc 24 adjusts to the temperature of the surrounding environment. For this reason and in accordance with generally recognized practice, the cap 26 is provided with an enlarged opening 48 in the end wall 46 thereof to provide effective thermal communication between the disc 24 and the environment surrounding the switch 10. However, it has now also been found that in order to further minimize response time it is important to minimize heat transfer from the disc 24 of a switch to the body portion 20 of the switch. Accordingly, the disc retainer 22 is formed so that it includes a plurality of fingers 32 having notches 33 therebetween to minimize the total available cross sectional area of the conductive paths between the shoulders 42 and the body portion 20. For similar reasons, the apertures 52 are provided in the sidewall portion 50 of the cap 26. Specifically, the apertures 52 reduce the total available cross sectional area of the conductive paths between the top wall portion 46 of the cap 26 and the portions of the sidewall portion 50 disposed below the apertures 52 which are in contact with the body portion 20. In this regard, it has been found the even though the disc retainer 22 and the body portion 20 are made of plastic materials having relatively low levels of thermal conductivity, by reducing the available thermally conductive paths between the disc 24 and the body portion 20 the response time for the switch 10 can be significantly reduced.

Referring to FIG. 2(*a*) a second embodiment of the disc assembly of the instant invention is illustrated and generally indicated at 84. The disc assembly 84 includes a disc retainer generally indicated at 86, a bimetallic disc 88 and a cap generally indicated at 90. The disc retainer 86 includes a hub portion 92 and a plurality of fingers 94 which define notches 95 therebetween and radiate outwardly from the hub portion 92 terminating in upwardly extending retainer projections 96 having inner faces 98 thereon. Shoulders 100 are formed adjacent the inner faces 98 and under cuts 102 are formed on the under sides of the fingers 94 below the projections 96 and the shoulders 100. The shoulders 100 are disposed substantially in a common plane and the shoulders 100 and the inner faces 98 are formed and positioned for supporting and containing the disc 88 on the retainer 86. Further, the retainer 86 is formed so that it is receivable in a body portion, such as the body portion 20 so that the under cut areas 102 which define the outermost portions of the bottom sides of the fingers 94 rest on the upper edge of the body portion. An aperture 104 is provided in the retainer 86 for receiving a transfer pin, such as the pin 82.

The bimetallic disc 88 is of conventional construction and it is made of dissimilar metals which cooperate to provide a flexing action in the disc 88 in response to a predetermined temperature condition.

The cap 90 is preferably made from a suitable sheet metal and it includes a top wall 106 having an enlarged central opening 108 therethrough and a sidewall or skirt portion 110 which depends from the top wall 106. The skirt portion 110 has a plurality of substantially uniformly spaced slots 112 formed therein which extend upwardly along the lower edge thereof and define a plurality of tabs 114. The cap 90 is received on the retainer 86 so that it is operative for retaining the disc 88 on the retainer 86 and for securing the disc assembly 84 to the remaining portions of a thermostat. The slots 112 are constructed so that they extend slightly above the under cut surfaces 102 so that when the disc assembly 84 is assembled on the body portion of a thermostatic switch, the portions of the skirt portion 110 which are disposed above the slots 112 are spaced from the body portion of the switch. The tabs 114 are inwardly bendable for securing the cap 90 to the body portion of a switch. However, because the slots 112 extend upwardly above the interface between the retainer 86 and the body portion of a switch, the slots 112 effectively reduce the total cross sectional area of the conductive paths available for conducting heat from the cap 90 to the body portion of the switch.

It is seen therefore that the instant invention provides an effective cap assembly and disc retainer therefor for a bimetallic disc-actuated thermostatic switch. The cap assemblies 12 and 84 are specifically adapted to minimize the thermally conductive paths between the discs 24 and 88 and the respective body portions of the switches in which the disc assemblies 12 and 84 are assembled. As a result, the bimetallic discs 24 and 88 are operative for rapidly responding to changes in the temperatures of the respective surrounding environments thereof. Consequently, the switches in which the disc assemblies 12 and 84 are assembled can be more effectively utilized for providing thermal overload protection for various appliances and electrical devices. For these reasons it is believed that the disc assemblies 12 and 84 of the instant invention represent significant advancements in the thermostatic switch art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A disc retainer for a bimetallic disc-actuated thermostatic switch comprising a central hub portion, at least three fingers which radiate outwardly from said hub portion defining open notches therebetween, a raised disc retainer projection adjacent the terminal end of each of said fingers, each of said disc retainer projections having an inner face which faces inwardly toward said hub portion and a raised disc support shoulder on each of said fingers adjacent the inner face of the disc retainer projection thereon, said disc support shoulders having upper support surfaces thereon which are disposed substantially within a common plane but being raised above the fingers thereof by amounts which are less than the amounts by which the adjacent disc retainer projections are raised above the respective fingers thereof.

2. The disc retainer of claim 1 further characterized as comprising six of said fingers, each of said fingers having one of said disc retainer projections and one of said disc support shoulders thereon.

3. The disc retainer of claim 1 further characterized as being integrally molded from a plastic material.

4. In the disc retainer of claim 1, said hub portion having a central axis and having an axial aperture therethrough.

5. In the disc retainer of claim 1, said hub portion having a central axis, the inner faces of said disc retainer projections being substantially uniformly spaced from said axis.

6. A bimetallic disc assembly for a bimetallic disc-actuated thermostatic switch comprising a disc retainer including a central hub portion, at least three fingers which radiate outwardly from said hub portion defining open notches therebetween, a raised disc retainer projection adjacent the terminal end of each of said fingers, each of said disc retainer projections having an inwardly facing inner face thereon and a raised disc support shoulder on each of said fingers adjacent the inner face of the disc retainer projection thereon, said disc support shoulders having upper support surfaces thereon which are disposed substantially within a common plane but being raised above the respective fingers thereof by amounts which are less then the amounts by which the adjacent disc retainer projections are raised above the respective fingers thereof, a bimetallic disc received in an assembled position wherein it is supported on said disc support shoulders so that it is received within said disc retainer projections, and a retainer cap received on said disc retainer for retaining said bimetallic disc in said assembled position and for securing said assembly to the body portion of a bimetallic disc-actuated thermostatic switch, said retainer cap including an end wall portion having an enlarged central opening therein and a skirt portion depending from said end wall portion and encircling said disc retainer, said end wall portion retaining said bimetallic disc in said assembled position, said skirt portion being receivable on said body portion for securing said assembly thereto.

7. In the assembly of claim 6, said skirt portion having a plurality of apertures therethrough, said apertures being substantially uniformly spaced around the circumference of said skirt portion.

8. In the assembly of claim 6, said skirt portion having a plurality of open ended slots formed therein, said slots being substantially uniformly spaced around the circumference of said skirt portion.

9. In the assembly of claim 6, said disc retainer including six of said fingers, each of said fingers having one of said disc retainer projections and one of said disc support shoulders thereon.

10. In the assembly of claim 6, said disc retainer being integrally molded from a plastic material.

11. In the assembly of claim 6, said hub portion having a central axis and having a central aperture therethrough.

12. In the assembly of claim 6, said hub portion having a central axis, the inner faces of said disc retainer projections being substantially uniformly spaced from said axis.

13. In the assembly of claim 7, said fingers having opposite top and bottom sides, said disc retainer projections and said support shoulders being disposed on the top sides of said fingers, said apertures being oriented so that they are disposed partially above and partially below the outermost portions of the bottom sides of said fingers.

14. In the assembly of claim 13, only those portions of said skirt portion which are disposed below the outermost portions of the bottom sides of said fingers being receivable on said body portion for securing said assembly thereto.

15. A disc retainer for a bimetallic disc-actuated thermostatic switch comprising a central hub portion, at least three fingers which radiate outwardly from said central hub portion, said fingers defining open notches therebetween and having opposite top and bottom sides, disc support means for supporting a bimetallic disc on said fingers in spaced relation to the top sides thereof, and retaining means on said fingers engageable with the perimeter of said disc for retaining said disc in position on said support means.

16. The disc retainer of claim 15 further characterized as comprising six of said fingers.

17. The disc retainer of claim 15 further characterized as being integrally molded from a plastic material.

18. A bimetallic disc assembly for a bimetallic disc-actuated thermostatic switch comprising a bimetallic disc, a disc retainer including a central hub portion, at least three fingers which radiate outwardly from said central hub portion, said fingers defining open notches therebetween and having opposite top and bottom sides, disc support means for supporting said bimetallic disc on said fingers in spaced relation to the top sides thereof, and retaining means on said fingers engageable with the perimeter of said disc for retaining said disc in an assembled position on said support means, and a retainer cap received on said disc retainer for retaining said bimetallic disc in said assembled position and for securing said assembly to the body portion of a thermostatic switch, said retainer cap including an end wall portion having an enlarged central opening therein and a skirt portion depending from the end wall portion and encircling said disc retainer, said end wall portion retaining said bimetallic disc in said assembled position, said skirt portion being receivable on said body portion for securing said assembly thereto.

* * * * *